US008065995B2

(12) United States Patent
Bakshi et al.

(10) Patent No.: US 8,065,995 B2
(45) Date of Patent: Nov. 29, 2011

(54) METHOD AND APPARATUS FOR CUTTING AND CLEANING WAFERS IN A WIRE SAW

(75) Inventors: Abhaya Kumar Bakshi, Westford, MA (US); Bhaskar Chandra Panigrahi, Southborough, MA (US)

(73) Assignee: Cambridge Energy Resources Inc, Cambridge, MA (US)

( * ) Notice: Subject to any disclaimer, the term of this patent is extended or adjusted under 35 U.S.C. 154(b) by 468 days.

(21) Appl. No.: 12/352,612

(22) Filed: Jan. 13, 2009

(65) Prior Publication Data

US 2010/0126490 A1 May 27, 2010

Related U.S. Application Data

(60) Provisional application No. 61/117,605, filed on Nov. 25, 2008.

(51) Int. Cl.
*B28D 1/08* (2006.01)

(52) U.S. Cl. ..... 125/21; 125/16.01; 125/16.02; 83/651.1

(58) Field of Classification Search ..... 125/16.01, 125/16.02, 21, 11.22; 451/67, 53, 449, 73, 451/7, 488; 134/6, 7, 16, 18, 26, 32, 34, 134/42; 83/651.1, 171, 169
See application file for complete search history.

(56) References Cited

U.S. PATENT DOCUMENTS 2,851,764 A * 9/1958 White ..... 407/11
2,967,381 A * 1/1961 Brown ..... 451/320
3,081,586 A * 3/1963 Gersbach ..... 451/41
5,771,876 A * 6/1998 Egglhuber ..... 125/21
5,890,481 A * 4/1999 Bigelow ..... 125/16.02
5,922,137 A * 7/1999 Fukunaga et al. ..... 134/2
5,944,007 A * 8/1999 Miyoshi et al. ..... 125/13.01
5,950,643 A * 9/1999 Miyazaki et al. ..... 134/25.4
6,018,884 A * 2/2000 Fukunaga et al. ..... 34/107
6,056,031 A * 5/2000 Banzawa et al. ..... 156/378
6,182,729 B1 * 2/2001 Banzawa et al. ..... 156/353
6,328,027 B1 * 12/2001 Persyk et al. ..... 125/21
6,463,920 B1 * 10/2002 Kondo et al. ..... 125/15
6,543,434 B2 * 4/2003 Holzmuller et al. ..... 125/21
6,652,356 B1 * 11/2003 Ariga ..... 451/7
6,920,871 B2 * 7/2005 Bieri ..... 125/16.02
6,941,940 B1 * 9/2005 Zavattari et al. ..... 125/16.02
7,025,054 B2 * 4/2006 Kondo et al. ..... 125/21
7,025,665 B2 * 4/2006 Bender ..... 451/296
7,306,508 B2 * 12/2007 Kawasaki et al. ..... 451/7
7,503,831 B2 * 3/2009 Radkevich et al. ..... 451/8
7,878,883 B2 * 2/2011 Gupta et al. ..... 451/7
2002/0115390 A1 * 8/2002 Kondo et al. ..... 451/49
2002/0174861 A1 * 11/2002 Lundt et al. ..... 125/21
2004/0084042 A1 * 5/2004 McAulay et al. ..... 125/21
2008/0295860 A1 * 12/2008 Burger ..... 134/1
2009/0223539 A1 * 9/2009 Gibbel ..... 134/2
2010/0126489 A1 * 5/2010 Bakshi et al. ..... 125/16.02
2010/0126490 A1 * 5/2010 Bakshi et al. ..... 125/21

* cited by examiner

*Primary Examiner* — George Nguyen
(74) *Attorney, Agent, or Firm* — Prakash Nama; Global IP Services, PLLC

(57) ABSTRACT

A method and apparatus of cutting and cleaning wafers in a wire saw is disclosed. In one embodiment, a wire sawing apparatus includes a horizontal ingot feeding wire slicing apparatus which includes a vertical wire web, in which sawing wires of the vertical wire web are located substantially in a vertical plane and move in a substantially vertical direction, a first top outlet and a second top outlet located in a top position with respect to a work piece for applying fluids during sawing, and at least one chute located substantially below the work piece for receiving the fluids, wherein the work piece is impelled against the vertical wire web by horizontal movement and the fluids flow in a vertical direction against and into the work piece for slicing and cleaning wafers.

24 Claims, 6 Drawing Sheets

METHOD AND APPARATUS FOR CUTTING AND CLEANING WAFERS IN A WIRE SAW

RELATED APPLICATIONS

This application claims priority under 35 U.S.C. 119 to U.S. Provisional Application No. 61/117605, entitled "METHOD AND APPARATUS FOR CUTTING AND CLEANING WAFERS IN A WIRE SAW" by Cambridge Energy Resources, Inc., filed on Nov. 25, 2008, which is incorporated herein its entirety by reference.

FIELD OF TECHNOLOGY

The present invention relates generally to wire sawing and more particularly relates to method and apparatus of cutting and cleaning wafers in a wire saw.

BACKGROUND

Wire saws are extensively used to slice silicon for solar and micro-electronics applications. The wire saws are also used for slicing a variety of other materials including sapphire, gallium arsenide (GaAs), indium phosphide (InP), silicon carbide (SiC), glass, lithium tantalate ($LiTaO_3$) Z-cut crystals, lithium niobate ($LiNbO_3$), lithium triborate ($LiB_3O_5$), quartz crystals, ceramics like aluminum nitride (ALN) and lead zirconate titanate (PZT), magnetic materials/parts, optical parts and the like material. The wire saws typically use a 120-180 micron diameter steel wire, which is several hundred kilometers long (FIG. 1). The wire is wound around a supply spool 110, a set of rollers called "wire guides" 130 to make a bed of parallel moving wire, often called "wire web" 140, and a take-up spool 120 as shown in FIG. 1. The wire guides 130 have equally spaced grooves on their outer surface to control spacing between the wires as it goes around the wire guides 130. The distance between the grooves, called pitch, eventually decides thickness of the wafers.

The work piece or the ingot 150, which needs to be sliced, is first glued to a plate 160 and then mounted on the wire saw. Then the ingot 150 is pressed with a vertical motion (top to bottom or bottom to top) against the horizontally moving wire web 140. The wire travels at a speed of about 15 meters/sec (or even higher) during slicing of wafers. Abrasive slurry, mainly made up of silicon carbide grains and a lubricant (e.g., polyethylene glycol or mineral oil), is introduced over the wire web 140. The abrasive slurry 210 coats the wire and travels to the cutting zone as shown in FIG. 2.

Also, it can be seen in FIG. 2 that, the abrasive slurry 210 tends to flow downwardly and away from the slicing zone, thereby significantly reducing the efficiency of slicing during the sawing operation. Further, it can be seen that a significant amount of abrasive slurry 210 is wasted by not being used in the slicing operation as the abrasive slurry 210 tends to flow downwardly and away from the cutting zone. Furthermore, it can be seen in FIG. 2 that, the abrasive slurry 210 flows perpendicular to direction of the horizontally moving wire web 140 (FIG. 2). Also, it can be seen in FIG. 2 that, majority of the abrasive slurry 210 does not pass through the ingot 150 and instead falls to the ground (bottom) of the wire saw. Further, in the conventional system using low viscosity slurries, risk of particles separating out of the abrasive slurry 210 is high.

Typically, slicing is achieved by slowly pushing the ingot 150 against the wire web 140. Furthermore, as cutting progresses, very fine silicon particles are loaded into the slurry. These particles in the slurry can increasingly adhere to the wafer surface as a function of time during the process. This is particularly true for very thin wafers, which require a much longer time to cut. Therefore, prompt cleaning is essential in all wire saw operations.

Slicing is completed when the ingot 150 completely passes through the wire web 140. At this point, the wafer stack which is held to the plate 160 is slowly pulled out of the wire web 140. After completing slicing and removing the stack of wafers from the wire saw the wafers are then cleaned immediately with water and other solvents to remove the abrasive slurry 210, otherwise the abrasive slurry 210 may stain the wafers thereby making them unusable in downstream processes. Further, the slurry remaining between the wafers needs to be removed quickly otherwise the slurry between the wafer can harden and hold the wafers together tightly and can make it difficult to remove and in some instances can break the wafers.

The current wire saws generate heat during slicing. Further, as the wafers become thinner, the cutting surface area increases significantly and as a result this can significantly increase the amount of heat generated during slicing. Also, the current wire saws cannot dissipate such heat generated during slicing. Further, lesser area is generally available for heat dissipation by radiation during slicing due to the slurry getting loaded between the wafers. This can lead to significant thermal stress in the wafers. Furthermore, the heat generated during slicing can soften the glue holding the stack of wafers to the plate 160. This can result in wafers dislodging from the plate 160 and breaking during slicing.

Further, as the silicon wafers are manufactured to thinner specifications, the sensitivity of these thinner wafers to any stress is significantly increased and these wafers can readily break. Currently, the standard for the solar industry is wafers sliced to a thickness of about 200 micrometers (microns; μm).

SUMMARY

A method and apparatus of cutting and cleaning wafers in a wire saw is disclosed. According to one aspect of the present invention, a wire sawing apparatus includes a horizontal ingot feeding wire slicing apparatus for slicing wafers, a frame for holding the horizontal ingot feeding wire slicing apparatus, and a control panel for operating the wire sawing apparatus.

Further, the horizontal ingot feeding wire slicing apparatus includes a vertical wire web such that sawing wires of the vertical wire web are located substantially in a vertical plane and move in a substantially vertical direction and at least one first top outlet and second top outlet for applying fluids during sawing, wherein the at least one first top outlet and second top outlet being located in a top position with respect to at least one work piece, such that the fluids flow in a substantially downward vertical direction under a gravitational force, and where the first top outlet supplies an abrasive slurry and the second top outlet supplies at least one cleaning fluid.

Also, the horizontal ingot feeding wire slicing apparatus includes at least one chute for removing the fluids, such that the at least one chute is located substantially below the at least one work piece for receiving the fluids, where the at least one work piece is impelled against the vertical wire web by movement in a horizontal direction, and where the fluids are applied to the top of the at least one work piece and the fluids flow in a vertical direction against and into the at least one work piece for slicing and cleaning wafers.

The horizontal ingot feeding wire slicing apparatus further includes at least two wire guide cylinders, such that the sawing wires are stretched between the at least two wire guide cylinders and held substantially in the vertical plane by a defining interval between the sawing wires, a tension control unit for controlling tension of the sawing wires, a support table for carrying the at least one work piece to be sliced, and a power driver for driving the at least two wire guide cylinders.

According to another aspect of the present invention, a method for producing wafers includes cutting a work piece including at least one ingot by impelling the work piece into a substantially vertical wire web, in which sawing wires of the substantially vertical wire web are located in a substantially vertical plane and move in a substantially vertical direction and in which the work piece is moved in a substantially horizontal direction into the substantially vertical wire web, and contacting the moving work piece for slicing wafers separately with at least two fluids including an abrasive slurry and a cleaning fluid, such that the at least two fluids flow in a substantially downward vertical direction under a gravitational force, in which the cleaning fluid cleans wafers of the resulting wafer stack during the impelling process, wherein moving the work piece and contacting with the at least two fluids slice the thin wafers secured at one end to a plate.

The methods and apparatuses disclosed herein may be implemented in any means for achieving various aspects. Other features will be apparent from the accompanying drawings and from the detailed description that follows.

BRIEF DESCRIPTION OF THE DRAWINGS

Embodiments of the present invention are illustrated by way of an example and not limited to the figures of the accompanying drawings, in which like references indicate similar elements and in which.

Other features of the present embodiments will be apparent from the accompanying drawings and from the detailed description that follows.

DETAILED DESCRIPTION

A method and apparatus for cutting and cleaning wafers in a wire saw is disclosed. In the following detailed description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

The terms "slicing", "sawing", "watering", and "cutting" are used interchangeably throughout the document.

Figure 1:
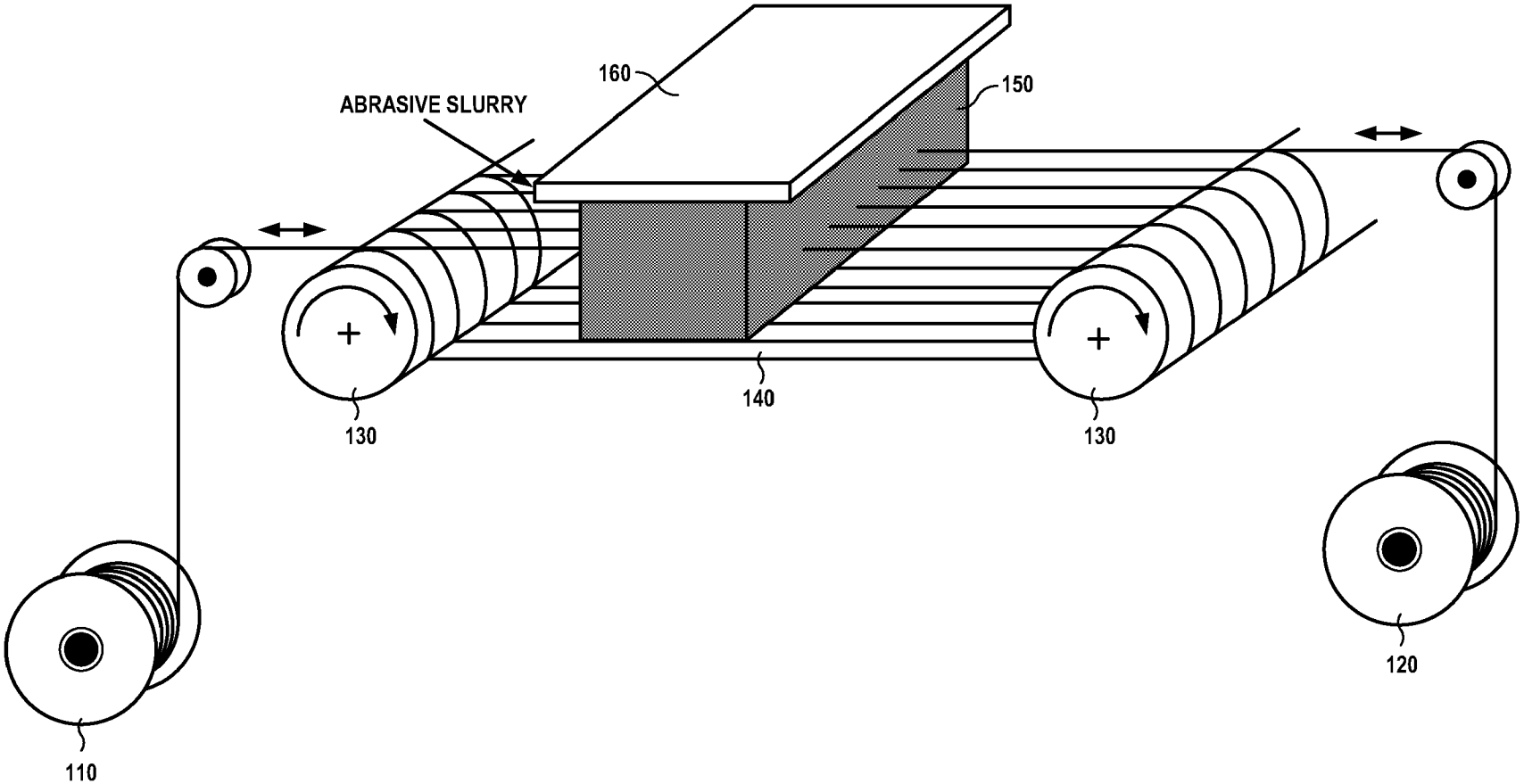
FIG. 1 (PRIOR ART)
FIG. 1 illustrates schematics of a conventional wire saw.
Figure 2:
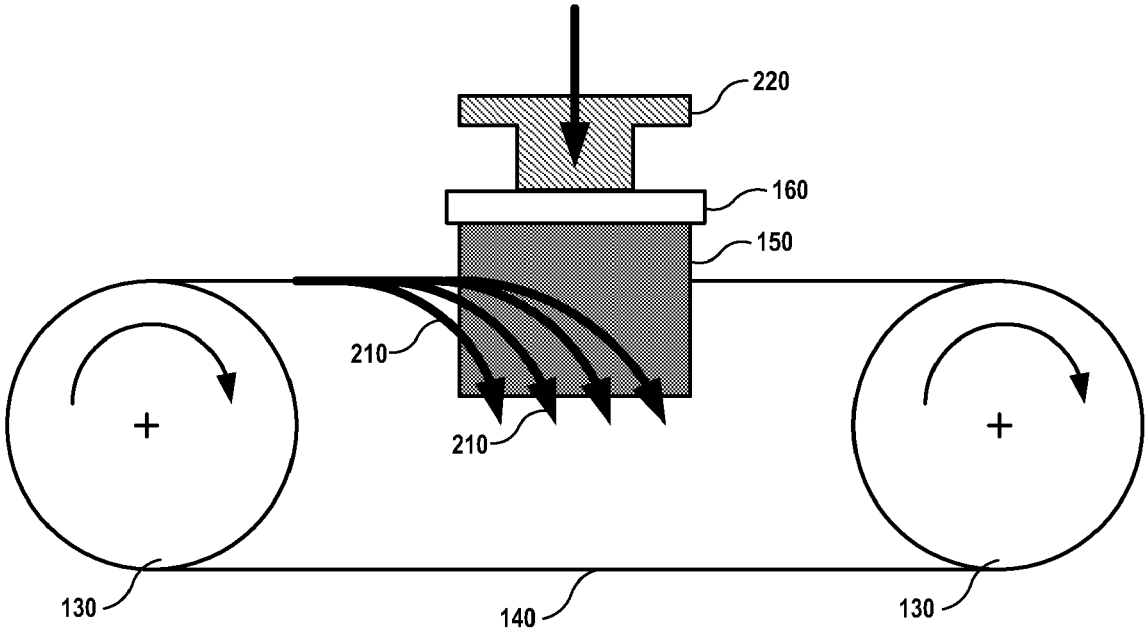
FIG. 2 (PRIOR ART)
FIG. 2 illustrates schematics of the slurry flow in the conventional wire saw, such as those shown in FIG. 1, through the wafers during cutting.
Figure 3:
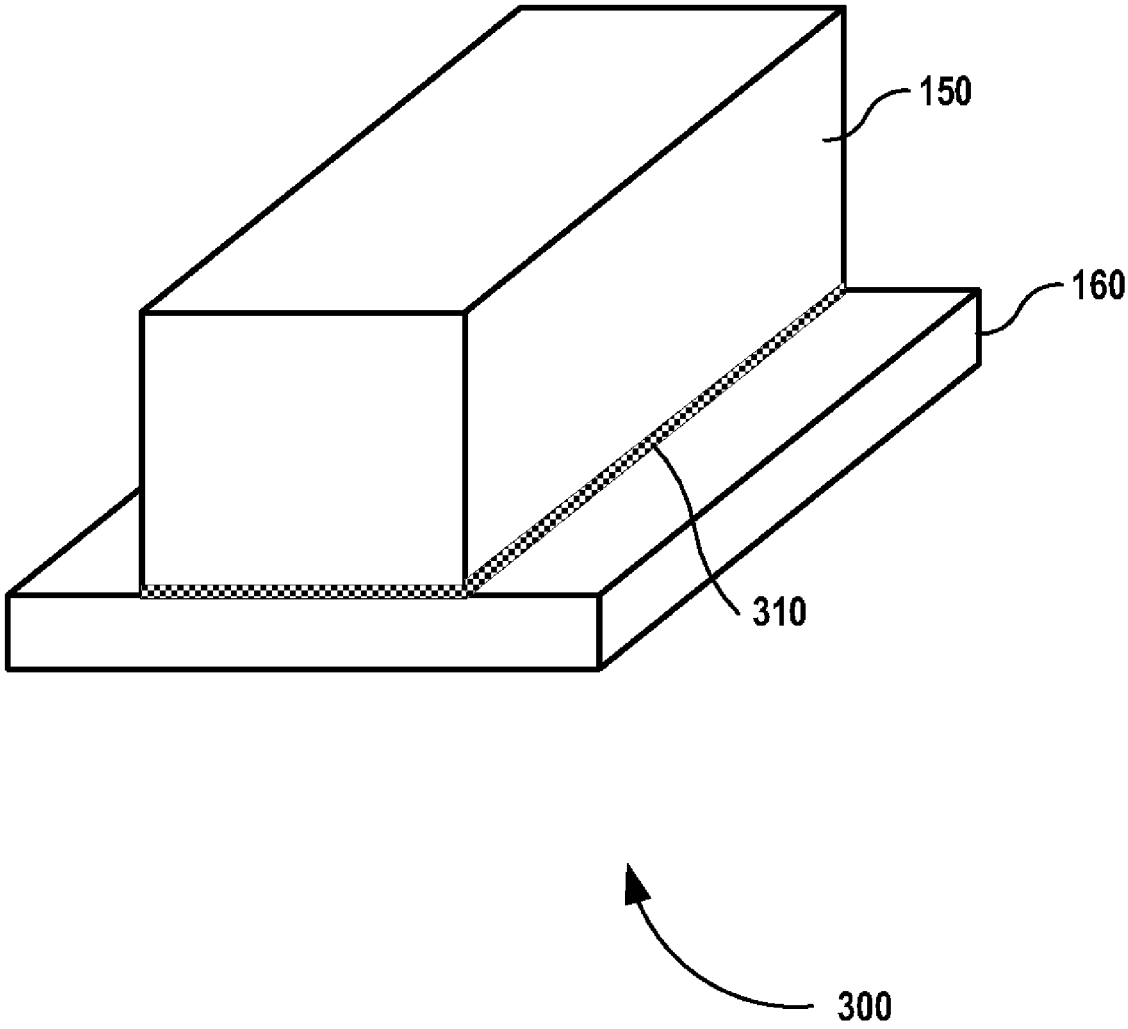
FIG. 3 illustrates an exemplary method of work piece preparation prior to loading on a wire sawing apparatus, such as those shown in FIG. 1, according to an embodiment of the present invention.

FIG. 3 illustrates an exemplary method 300 of work piece preparation prior to loading on a wire sawing apparatus (e.g., the wire sawing apparatus 600 of FIG. 6), according to an embodiment of the present invention. As shown in FIG. 3, a work piece 150 is attached to a plate 160. For example, the work piece 150 may be silicon (Si), sapphire, gallium arsenide (GaAs), indium phosphide (InP), silicon carbide (SiC), lithium tantalate ($LiTaO_3$) Z-cut crystals, lithium niobate ($LiNbO_3$), lithium triborate ($LiB_3O_5$), quartz crystals, ceramics like aluminum nitride (ALN) and lead zirconate titanate (PZT), magnetic materials/parts, optical parts, or glass. Further, the work piece 150 may be mono-crystalline silicon (i.e., the work piece 150 grown from a single crystal) or multi-crystalline silicon. The plate 160 may be glass, ceramic, plastic, silicon or a like material.

In one exemplary implementation, the work piece 150 is attached to the plate 160 by glue 310. It is appreciated that gluing of the work piece 150 to the plate 160 ensures secured holding of sliced wafers to the plate 160. One skilled in the art can envision that the work piece 150 can be attached to the plate 160 using other techniques that are well known in the art.

Figure 4:
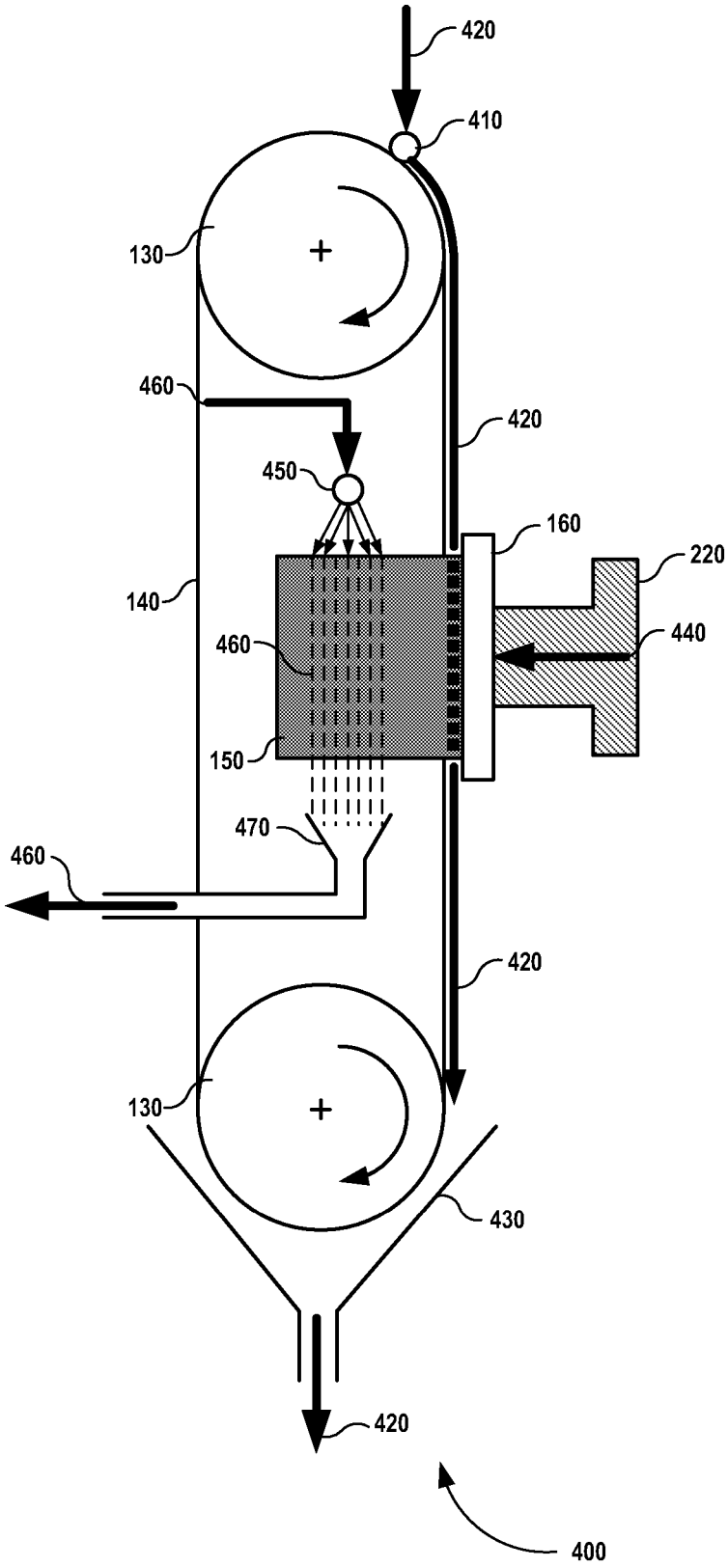
FIG. 4 illustrates an exemplary horizontal ingot feeding wire slicing and cleaning apparatus and a method thereof, according to an embodiment of the present invention.

FIG. 4 illustrates an exemplary horizontal ingot feeding wire slicing and cleaning apparatus 400 and a method thereof, according to an embodiment of the present invention. As shown in FIG. 4, the horizontal ingot feeding wire slicing and cleaning apparatus 400 includes a vertical wire web 140, a first top outlet 410, a second top outlet 450, a first chute 430 and a second chute 470.

It can be seen in FIG. 4 that, sawing wires of the vertical wire web 140 are located in a vertical plane and move in a substantially vertical direction. In some embodiments, the sawing wires of the vertical wire web 140 are formed by spirally winding between two wire guides cylinders 130. In these embodiments, the sawing wires are stretched between the two wire guide cylinders 130 and held substantially in the vertical plane by a defining interval between the sawing wires.

Further, as shown in FIG. 4, the work piece 150 (e.g., including one or more ingots) to be sliced by the horizontal ingot feeding wire slicing and cleaning apparatus 400 is attached to the plate 160. In one exemplary implementation, the work piece 150 is attached to the plate 160 by glue 310 (e.g., as shown in FIG. 3). It is appreciated that, the plate 160 is located substantially laterally on a side of the vertical wire web 140 in a substantially vertical plane that is parallel to the plane of the vertical wire web 140. As shown in FIG. 4, a support table 220 of the horizontal ingot feeding wire slicing and cleaning apparatus 400 carries the work piece 150 attached to the plate 160.

In operation, the work piece 150 is impelled against the vertical wire web 140 by movement in a horizontal direction (e.g., as shown by reference numeral 440) for slicing wafers. In one embodiment, the work piece 150 including a plurality of ingots is impelled substantially simultaneously to the vertical wire web 140. In an alternate embodiment, the work piece 150 including the plurality of ingots is impelled substantially serially to the vertical wire web 140. It is appreciated that the sawing wires of the vertical wire web 140 are adapted to move in a substantially vertical alternating or continuous direction while impelled against the work piece 150.

Further, in accordance with the above-described embodiments, the first top outlet 410 and the second top outlet 450 are located in a top position with respect to the work piece 150 for applying fluid 420 and a cleaning fluid 460 respectively, during the sawing operation. In one exemplary implementation, the first top outlet 410 is located and oriented to substantially flow the fluid 420 over the top of the work piece 150 as the work piece 150 is impelled against the vertical wire web 140 and during the slicing of the wafers. For example, the fluid 420 is abrasive slurry.

Further, as shown in FIG. 4, the first chute 430 is located substantially below the work piece 150 for removing the fluid 420. In one exemplary implementation, the fluid 420 is applied using the first chute 430 to the top of the work piece 150 and the applied fluid 420 flows in a vertical direction against and into the work piece 150 for slicing the wafers, which is finally received by the first chute 430.

Further, the second top outlet 450 is located and oriented to substantially spray the cleaning fluid 460 over wafers as cut wafers emerge from the vertical wire web 140. In some embodiments, the cleaning fluid 460 includes a surfactant such that the wafers in the vertical wire web 140 are maintained in a separate condition by electrostatic repulsion. In these embodiments, the cleaning fluid 460 also includes water or high heat dissipating fluids. As shown in FIG. 4, the second chute 470 is located substantially below the work piece 150 for removing the cleaning fluid 460 after the cleaning fluid 460 flows between the cut wafers and cleans the cut wafers emerging from the vertical wire web 140.

It can be seen in FIG. 4 that, the fluid 420 and the cleaning fluid 460 flow separately in a substantially downward vertical direction under a gravitational force and thus the cleaning fluid 460 does not dilute the fluid 420 which remains on the opposite side of the vertical wire web 140. As a result, both cutting and cleaning progress without interference. Also, it can be seen in FIG. 4 that, the first chute 430 and the second chute 470 separately removes each of the fluid 420 and the cleaning fluid 460. Even though FIG. 4 recites using separate outlets and chutes for the abrasive slurry and the cleaning fluid, it can be envisioned that a single outlet and a single chute can be configured to be used for the both the abrasive slurry and the cleaning fluid.

According to the one or more embodiments described above, the method for producing wafers using the above-described horizontal ingot feeding wire slicing and cleaning apparatus 400 includes cutting the work piece 150 that includes one or more ingots by impelling the work piece 150 substantially into the vertical wire web 140 and contacting the moving work piece 150 for slicing thin wafers separately with the fluid 420 (e.g., an abrasive slurry) and the cleaning fluid 460. The cleaning fluid 460 cleans wafers of the resulting wafer stack during the impelling process. Further, moving and contacting the work piece 150 with the fluid 420 and the cleaning fluid 460 slice the thin wafers secured at one end to the plate 160. In addition, the method includes dissipating heat during cleaning by adjusting slicing rate and thermal properties of the abrasive slurry 420 and the cleaning fluid 460.

Figure 5:
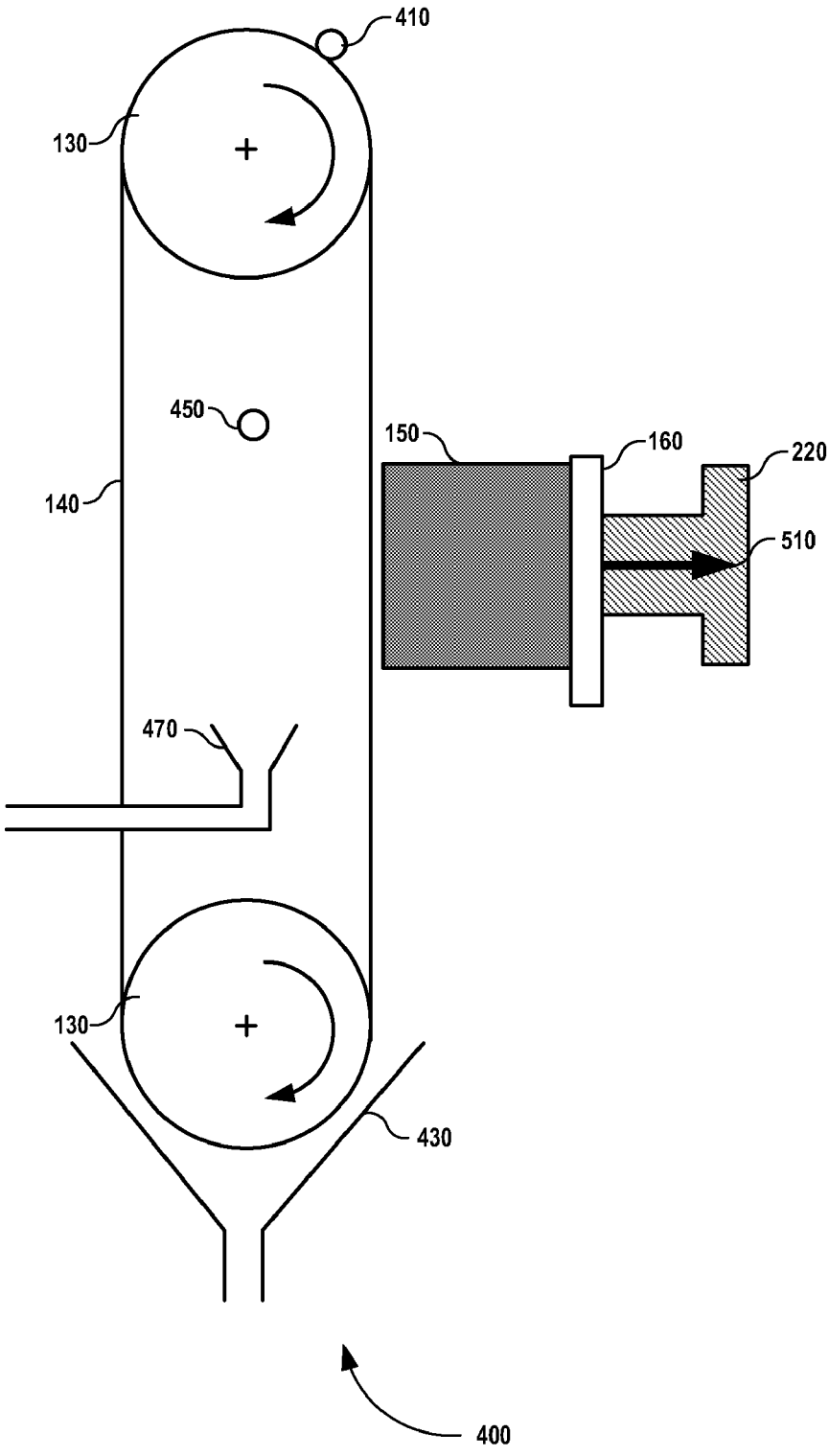
FIG. 5 illustrates the exemplary horizontal ingot feeding wire slicing and cleaning apparatus shown in FIG. 4, wherein the sliced wafers are removed after slicing process, according to an embodiment of the present invention.

FIG. 5 illustrates the exemplary horizontal ingot feeding wire slicing and cleaning apparatus 400 shown in FIG. 4, wherein the sliced wafers are removed after slicing process, according to an embodiment of the present invention. The slicing process is completed when the work piece 150 completely passes through the vertical wire web 140 and the cut wafers are simultaneously cleaned using the cleaning fluid 460.

As shown in FIG. 5, the sliced wafers secured to the plate 160 are slowly pulled out (indicated by a reference numeral 510) of the vertical wire web 140. It is appreciated that thickness of the sliced wafers are separated from each other by sawing gaps due to the defining interval between the sawing wires. In one example embodiment, the thickness of each sliced wafer is less than about 800 microns, less than about 500 microns, less than about 300 microns, less than about 200 microns, less than about 150 microns, less than about 100 microns, or less than about 50 microns. Further, stack of wafers are removed from the horizontal ingot feeding wire slicing and cleaning apparatus 400 and taken for processing, which is well known to a person skilled in the art.

Figure 6:
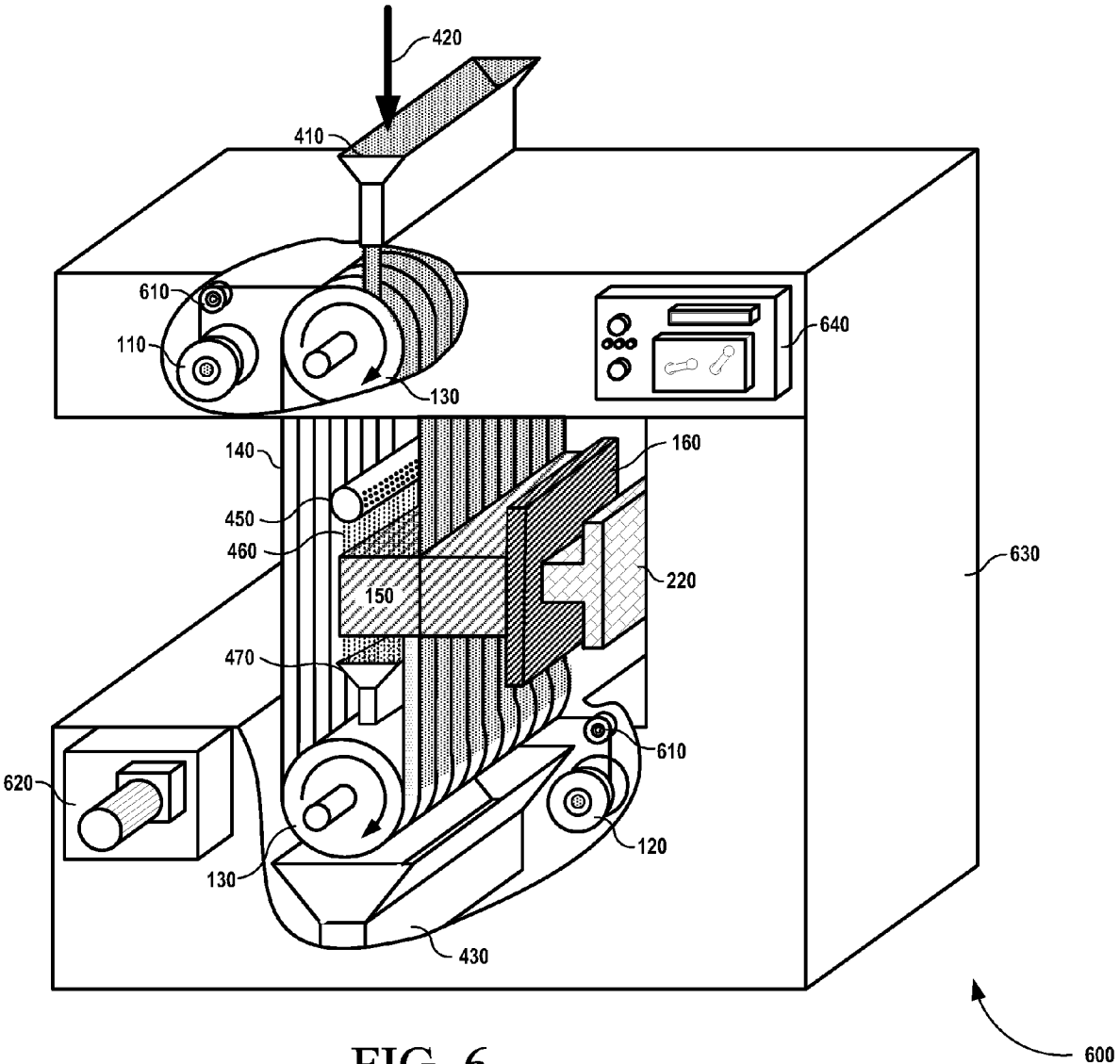
FIG. 6 illustrates an exemplary wire sawing apparatus including the horizontal ingot feeding wire slicing and cleaning apparatus such as those shown in FIGS. 4 and 5, according to an embodiment of the present invention.

FIG. 6 illustrates an exemplary wire sawing apparatus 600 including the horizontal ingot feeding wire slicing and cleaning apparatus 400 such as those shown in FIGS. 4 and 5, according to an embodiment of the present invention. It is appreciated that the horizontal ingot feeding wire slicing and cleaning apparatus 400 is a retrofittable device that is designed to be integrated into the wire sawing apparatus 600. One can envision that, the horizontal ingot feeding wire slicing and cleaning apparatus 400 can be integrated into any existing wire sawing apparatus. As shown in FIG. 6, the horizontal ingot feeding wire slicing and cleaning apparatus 400 includes a supply spool 110, a take-up spool 120, the wire guide cylinders 130, the vertical wire web 140, the first top outlet 410, the second top outlet 450, the first chute 430, the second chute 470, a tension control unit 610, the support table 220 and a power driver 620.

As shown in FIG. 6, the sawing wires of the vertical wire web 140 are located substantially in a vertical plane and move in a substantially vertical direction. Also, as shown in FIG. 6, the sawing wires of the vertical wire web 140 are stretched between the wire guide cylinders 130. It can be seen in FIG. 6 that, the sawing wires of the vertical wire web 140 are spirally wound around the supply spool 110, the two wire guide cylinders 130 and the take-up spool 120.

Further, as shown in FIG. 6, the first top outlet 410 and the second top outlet 450 are located in a top position with respect to the work piece 150. According to an embodiment of the present invention, the first top outlet 410 and the second top outlet 450 apply the fluid 420 and the cleaning fluid 460 respectively, during sawing, where the fluid 420 and the cleaning fluid 460 flow in a substantially downward vertical direction under the gravitational force. It can be seen in FIG. 6 that, the first top outlet 410 is located and oriented such that the fluid 420 substantially flows over the top of the work piece 150 as the work piece 150 is impelled against the vertical wire web 140 and during slicing of wafers. Further, it can be seen in FIG. 6 that, the first chute 430 is located substantially below the work piece 150 for removing the fluid 420 used in the slicing process.

The second top outlet 450 is located and oriented to substantially spray the cleaning fluid 460 over the wafers as the cut wafers emerge from the vertical wire web 140. Also, as shown in FIG. 6, the second chute 470 is located substantially below the work piece 150 for removing the cleaning fluid 460 after the cleaning fluid 460 cleans the cut wafers emerging from the vertical wire web 140. It is appreciated that the cleaning fluid 460 flows separately from the fluid 420 in a substantially downward vertical direction under the gravitational force, thus not diluting the fluid 420. It is also appreciated that each of the fluid 420 and the cleaning fluid 460 are separately removed through the first chute 430 and the second chute 470 respectively.

According to the above-described embodiments, the tension control unit 610 controls tension of the sawing wires, the support table 220 carries the work piece 150 to be sliced and cleaned and the power driver 620 drives the wire guide cylinders 130. It is appreciated that the support table 220 along with other elements form a horizontal ingot feeding device in the horizontal ingot feeding wire slicing and cleaning apparatus 400. In one exemplary implementation, the horizontal ingot feeding device is arranged to maintain, during slicing, partially or completely sliced wafers substantially parallel to each other and such that the width of the sawing gaps is held substantially constant during slicing of the wafers.

Further, the horizontal ingot feeding wire slicing and cleaning apparatus 400 and a method thereof is described in greater detail with respect to FIG. 4. The wire sawing apparatus 600 also includes a frame 630 for holding the horizontal ingot feeding wire slicing and cleaning apparatus 400 and a control panel 640 that may be attached to the frame 630 for operating the wire sawing apparatus 600, according to the example embodiment illustrated in FIG. 6.

With reference to the above-described wafer cutting technique, a plurality of zones is envisioned with respect to the work piece 150 and the vertical wire web 140, in terms of placement of sources of the fluid 420, and collection of the fluid 420. Thus, there is a "pre-saw" zone in which the fluid 420 is contacted to the work piece 150.

An embodiment of the present invention, designed to solve the hydrodynamic stress problem without breakage of wafers, provides a design of the wire sawing apparatus in which the work piece is impelled against the vertical wire web by movement in a horizontal direction. Unlike conventional wire saws, in which the fluid is fed over a horizontal wire web, in the present method and apparatus, the fluids are fed downward across the vertical wire web (as illustrated in FIG. 4). As a result, the fluids migrate into the work piece by advantageously responding to the gravitational force as well as the drag force of the fast moving vertical wire web. This arrangement forces the fluids to pass through the cutting zone of the work piece.

An advantage of gravity assisted vertical fluid flow in the design of the wire sawing apparatus herein is that, particles do not settle out of the abrasive slurry. Rather the entire abrasive slurry is forced to pass through the cutting zone of the work piece. Use of the vertical wire sawing apparatus further enables use of low viscosity slurries, which imparts lower stress on the wafers. Further, by use of the above-described wire sawing apparatus, a larger number of abrasive particles are introduced into the cutting zone, and efficiency of the cutting process is thereby significantly increased. Further, the consumable cost of the slicing process is decreased. However, viscosity of the abrasive slurry still increases once the slicing process is initiated, as silicon fines become loaded into the fluid. Also, in spite of the high viscosity of the abrasive slurry, the abrasive slurry still do not entirely prevent particles from settling, a result which can prevent cutting. Therefore, for processes of manufacture of very thin wafers as described herein address the problem of the necessity to remove trapped abrasive slurry, a step which would allow the wafers to be pulled away from the vertical wire web without breaking them.

A major advantage of the design of the system herein, is accomplishing cleaning of the wafers as the cut wafers emerge out of the vertical wire saw. By cleaning the wafers this way, according to the design of the apparatus and method herein, separating the cut and finished wafers from each other when the cutting is complete is facilitated, as there is no slurry remaining between the wafers to obstruct the wire movement. In addition, surfactants such as sodium silicate are added to the cleaning fluid, which electro-statically keeps the wafers separate from each other. Cleaning of the wafers in the wire saw substantially reduces breakage of wafers. One skilled in the art will appreciate that prompt cleaning of the wafers removes foreign particles adhering to the wafers.

A skilled person will recognize that many suitable designs of the systems and processes may be substituted for or used in addition to the configurations described above. It should be understood that the implementation of other variations and modifications of the embodiments of the invention and its various aspects will be apparent to one ordinarily skilled in the art, and that the invention is not limited by the exemplary embodiments described herein and in the claims. Therefore, it is contemplated to cover the present embodiments of the invention and any and all modifications, variations, or equivalents that fall within the true spirit and scope of the basic underlying principles disclosed and claimed herein. The contents of all references cited are incorporated herein by reference in their entireties.

What is claimed is:

1. A wire sawing apparatus, comprising:

a horizontal ingot feeding wire slicing and cleaning apparatus, wherein the horizontal ingot feeding wire slicing apparatus comprises:

a vertical wire web, wherein sawing wires of the vertical wire web are located substantially in a vertical plane and move in a substantially vertical direction;

at least one first top outlet and second top outlet for applying fluids during sawing, wherein the at least one first top outlet being located in a top position with respect to at least one work piece and wherein the fluids flow in a substantially downward vertical direction under a gravitational force and wherein the first top outlet supplies an abrasive slurry and the second top outlet supplies at least one cleaning fluid;

at least one chute for removing the fluids, wherein the at least one chute is located substantially below the at least one work piece for receiving the fluids, wherein the at least one work piece is impelled against the vertical wire web by movement in a horizontal direction, and wherein the abrasive slurry is applied to the top of the at least one work piece and the abrasive slurry flows in a vertical direction against and into the at least one work piece for slicing wafers, and wherein the at least one second top outlet being located in a top position of the sliced wafers to provide the at least one cleaning fluid for cleaning debris between the sliced wafers;

two wire guide cylinders, wherein the sawing wires are stretched between the two wire guide cylinders and held substantially in the vertical plane by a defining interval between the sawing wires;

a tension control unit for controlling tension of the sawing wires;

a support table for carrying the at least one work piece to be sliced;

a power driver for driving the two wire guide cylinders;

a frame for holding the horizontal ingot feeding wire slicing apparatus; and a control panel for operating the wire sawing apparatus.

2. The apparatus according to claim 1, wherein the at least one first top outlet is located and oriented to substantially flow the abrasive slurry over the top of the at least one work piece as the work piece is impelled against the vertical wire web and during slicing of the wafers.

3. A wire sawing apparatus, comprising:

a horizontal ingot feeding wire slicing and cleaning apparatus, wherein the horizontal ingot feeding wire slicing apparatus comprises:

a vertical wire web, wherein sawing wires of the vertical wire web are located substantially in a vertical plane and move in a substantially vertical direction;

at least one first top outlet and second top outlet for applying fluids during sawing, wherein the at least one first top outlet being located in a top position with respect to at least one work piece, wherein the fluids flow in a substantially downward vertical direction under a gravitational force, wherein the first top outlet supplies an abrasive slurry and the second top outlet supplies at least one cleaning fluid, and wherein the at least one first top outlet is located and oriented to substantially flow the abrasive slurry over the top of the at least one work piece as the work piece is impelled against the vertical wire web and during slicing of the wafers;

at least one chute for removing the fluids, wherein the at least one chute is located substantially below the at least one work piece for receiving the fluids, wherein the at least one work piece is impelled against the vertical wire web by movement in a horizontal direction, and wherein the abrasive slurry is applied to the top of the at least one work piece and the abrasive slurry flows in a vertical direction against and into the at least one work piece for slicing wafers, and wherein the at least one second top outlet being located in a top position of the sliced wafers to provide the at least one cleaning fluid for cleaning the sliced wafers, wherein the at least one second top outlet is located and oriented to substantially spray the at least one cleaning fluid over the sliced wafers as the sliced wafers emerge from the vertical wire webs;

two wire guide cylinders, wherein the sawing wires are stretched between the two wire guide cylinders and held substantially in the vertical plane by a defining interval between the sawing wires;

a tension control unit for controlling tension of the sawing wires;

a support table for carrying the at least one work piece to be sliced;

a power driver for driving the two wire guide cylinders;

a frame for holding the horizontal ingot feeding wire slicing apparatus; and a control panel for operating the wire sawing apparatus.

4. The apparatus according to claim 3, wherein the at least one chute is a first chute and a second chute for separately removing each of the abrasive slurry and the cleaning fluid.

5. The apparatus according to claim 1, wherein the at least one work piece is attached to a plate, and the plate is located substantially laterally on a side of the vertical wire web in a substantially vertical plane that is parallel to the plane of the vertical wire web, wherein during the horizontal movement of the at least one work piece against the vertical wire web, the sliced and cleaned wafers are secured to the plate, and wherein the plate comprises glass, silicon, ceramic, or plastic material.

6. The apparatus according to claim 5, wherein the work piece is attached to the plate by glue.

7. The apparatus according to claim 1, wherein the at least one cleaning fluid comprises at least one surfactant, wherein the wafers in the vertical wire web are maintained in a separate condition by electrostatic repulsion.

8. The apparatus accordingly to claim 1, wherein the at least one cleaning fluid further comprises water or high heat dissipating fluids.

9. The apparatus according to claim 1, wherein the at least one work piece comprises a plurality of ingots.

10. The apparatus according to claim 9, wherein the plurality of ingots is impelled substantially simultaneously to the vertical wire web.

11. The apparatus according to claim 9, wherein the plurality of ingots is impelled substantially serially to the vertical wire web.

12. The apparatus according to claim 1, wherein the at least one work piece comprises silicon (Si), sapphire, gallium arsenide (GaAs), indium phosphide (InP), silicon carbide (SiC), lithium tantalate (LiTaO3) Z-cut crystals, lithium niobate (LiNbO3), lithium triborate (LiB3O5), quartz crystals, ceramics including aluminum nitride (ALN) or lead zirconate titanate (PZT), magnetic materials/parts, optical parts or glass.

13. The apparatus according to claim 12, wherein the silicon is selected from the group consisting of mono-crystalline and multi-crystalline.

14. A horizontal ingot feeding wire slicing and cleaning apparatus, comprising:

a vertical wire web, wherein sawing wires of the vertical wire web are located substantially in a vertical plane and move in a substantially vertical direction;

at least one first top outlet and second top outlet for applying fluids during sawing, wherein the at least one first top outlet being located in a top position with respect to at least one work piece and wherein the fluids flow in a substantially downward vertical direction under a gravitational force and wherein the first top outlet supplies an abrasive slurry and the second top outlet supplies at least one cleaning fluid;

at least one chute for removing the fluids, wherein the at least one chute is located substantially below the at least one work piece for receiving the fluids, wherein the at least one work piece is impelled against the vertical wire web by movement in a horizontal direction, and wherein the abrasive slurry is applied to the top of the at least one work piece and the abrasive slurry moves in a vertical direction against and into the at least one work piece for slicing wafers, and wherein the at least one second top outlet being located in a top position of the sliced wafers to provide the at least one cleaning fluid for cleaning debris between the sliced wafers; and two wire guide cylinders, wherein the sawing wires are stretched between the two wire guide cylinders and held substantially in the vertical plane by a defining interval between the sawing wires.

15. The apparatus according to claim 14, further comprising:

a tension control unit for controlling the tension of the sawing wires;

a support table for carrying the at least one work piece to be sliced;

and a power driver for driving the two wire guide cylinders.

16. The apparatus according to claim 14, wherein the sawing wires are stretched between the two wire guide cylinders and held in the substantially vertical plane by the defining interval between the sawing wires, thereby thickness of the sliced and cleaned wafers separated from each other by sawing gaps, wherein the sawing wires are adapted to move in a substantially vertical alternating or continuous direction while impelled against the at least one work piece.

17. The apparatus according to claim 14, further comprising:

a horizontal ingot feeding device arranged to maintain, during slicing and cleaning, partially or completely sliced and cleaned wafers substantially parallel to each other and such that the width of the sawing gaps is held substantially constant during slicing of the wafers.

18. The apparatus according to claim 16, wherein the sawing wires of the vertical wire web are formed by spirally winding between the two wire guide cylinders.

19. The apparatus according to claim 15, wherein the horizontal ingot feeding wire slicing apparatus is a retrofittable device that is designed to be integrated into a wire sawing apparatus.

20. A method for producing wafers, the method comprising:

cutting a work piece comprising at least one ingot by impelling the work piece into a substantially vertical wire web, wherein sawing wires of the substantially vertical wire web are located in a substantially vertical plane and move in a substantially vertical direction, and wherein the work piece is moved in a substantially horizontal direction into the substantially vertical wire web; and contacting the moving work piece for slicing into wafers and cleaning the sliced wafers separately with at least two fluids comprising an abrasive slurry and a cleaning fluid, wherein the at least two fluids flow in a substantially downward vertical direction under at least a gravitational force, wherein the cleaning fluid cleans the sliced wafers of resulting wafer stack during the impelling process, and wherein moving the work piece and contacting the moving work piece with the at least two fluids slice and clean the sliced wafers secured at one end to a plate.

21. The method according to claim 20, wherein thickness of each sliced wafer is less than about 800 microns, less that about 500 microns, less than about 300 microns, less than about 200 microns, less than about 150 microns, less than about 100 microns, or less than about 50 microns.

22. The method according to claim 20, wherein the plate comprises glass, ceramic, plastic, or silicon material and the work piece is glued to the plate.

23. The method according to claim 20, wherein the work piece comprises silicon (Si), sapphire, gallium arsenide (GaAs), indium phosphide (InP), silicon carbide (SiC), lithium tantalate (LiTaO3) Z-cut crystals, lithium niobate (LiNbO3), lithium triborate (LiB3O5), quartz crystals, ceramics including aluminum nitride (ALN) or lead zirconate titanate (PZT), magnetic materials/parts, optical parts or glass.

24. The method according to claim 20, further comprising:

during cleaning, dissipating heat by adjusting slicing rate and thermal properties of the abrasive slurry and the cleaning fluids.

* * * * *